US009156526B2

(12) United States Patent
Handley

(10) Patent No.: US 9,156,526 B2
(45) Date of Patent: Oct. 13, 2015

(54) EXPANDABLE PONTOON SYSTEM

(71) Applicant: Ian Matthew Handley, Wisconsin Dells, WI (US)

(72) Inventor: Ian Matthew Handley, Wisconsin Dells, WI (US)

( * ) Notice: Subject to any disclaimer, the term of this patent is extended or adjusted under 35 U.S.C. 154(b) by 1 day.

(21) Appl. No.: 14/248,088

(22) Filed: Apr. 8, 2014

(65) Prior Publication Data

US 2014/0299029 A1 Oct. 9, 2014

Related U.S. Application Data

(60) Provisional application No. 61/810,133, filed on Apr. 9, 2013.

(51) Int. Cl.
*B63B 1/00* (2006.01)
*B63B 7/02* (2006.01)
*B63B 35/34* (2006.01)

(52) U.S. Cl.
CPC .. *B63B 7/02* (2013.01); *B63B 35/34* (2013.01)

(58) Field of Classification Search
CPC ..... B63B 7/00; B63B 7/02; B63B 7/04; B63B 35/34; B63B 35/36; B63B 2007/00
USPC ..... 114/56.1, 61.18, 283, 284, 292
See application file for complete search history.

(56) References Cited

U.S. PATENT DOCUMENTS 1,710,625 A * 4/1929 Kapigian ..... 114/123
2,992,444 A * 7/1961 Schuler ..... 114/344
3,114,157 A * 12/1963 Stockmann ..... 441/45
3,673,622 A * 7/1972 Allen ..... 114/344
3,792,502 A * 2/1974 Odegaard ..... 114/344
3,802,006 A * 4/1974 Nelson et al. ..... 114/344
3,925,837 A * 12/1975 Miller ..... 114/352
4,909,169 A * 3/1990 Skandaliaris et al. ..... 114/61.18
6,003,458 A * 12/1999 Valliere ..... 114/61.18
6,178,913 B1 * 1/2001 Brignolio ..... 114/353
6,298,802 B1 * 10/2001 Brignolio ..... 114/344
6,439,145 B1 * 8/2002 Mensch ..... 114/61.18
6,647,913 B2 * 11/2003 Brignolio ..... 114/344
8,820,255 B1 * 9/2014 Poppell et al. ..... 114/61.18
9,045,195 B2 * 6/2015 Poppell ..... 1/1
2007/0056496 A1 * 3/2007 Hodgson ..... 114/61.15

* cited by examiner

*Primary Examiner* — Daniel V Venne

(57) ABSTRACT

An extendable pontoon system is provided. The extendable pontoon system may include a center pontoon, two side pontoons, an adjustable frame and a plurality of actuator arms. The adjustable frame may include a plurality of fixed frame elements and a plurality of slidable elements. The plurality of fixed frame elements may be supported in a traverse relationship to and along the length of the center pontoon. Each elongated slidable element may have a received end and a hinged end. Each fixed frame element may be tubular having two opposing ends, wherein each opposing end may be adapted to slidably receive one received end. The plurality of hinged ends may be pivotably connected to either one of the two side pontoons. Each actuator arm has a fixed end and an extendable end, wherein the plurality of fixed ends are connected to one fixed frame element, and wherein the plurality of extendable ends are connected to the two side pontoons so that the two side pontoons are extendable relative to the center pontoon by shifting the two side pontoons between a contracted position to an expanded position.

7 Claims, 5 Drawing Sheets

EXPANDABLE PONTOON SYSTEM

CROSS-REFERENCE TO RELATED APPLICATION

This application claims the benefit of priority of U.S. provisional application number 61/810,133 filed 9 Apr. 2013 the contents of which are herein incorporated by reference.

BACKGROUND OF THE INVENTION

The present invention relates to watercraft and, more particularly, to an expandable plurality-hull pontoon boat.

The width of pontoon boats is typically constrained by the limitations of slip-docking, storage, trailer preparation and other transportation considerations. Currently, expandable or extendable pontoon boats are limited in deck width because of the rigid attachment between the pontoons and the adjustable frame carrying the deck. Instructively, hull strength is a function of frame width As can be seen, there is a need for wider extendable pontoon boats that may be placed in a contracted configuration for storage and transportation considerations yet be placed in an expanded configuration once afloat.

SUMMARY OF THE INVENTION

In one aspect of the present invention, a plurality-hull boat comprises: a center hull comprising: a center buoyancy section; a plurality of fixed frame elements, wherein each fixed frame elements is an elongated tube connected in a transverse relationship to and along the length of the center buoyancy section; and a fixed deck supported by the plurality of fixed frame elements; two side hulls, wherein one side hull is disposed on the port side of the center hull and the other side hull is disposed on the starboard side of the center hull, with each side hull comprising: a side buoyancy section; a plurality of slidable elements, wherein each slidable element has a received end and a hinged end, wherein each received end is slidably received by a complementary fixed frame element, wherein each hinged end is pivotably connected along the length of the side buoyancy section; and a mobile deck supported by the plurality of hinged ends; and a plurality of actuator arms, wherein each actuator arm has a fixed end and an extendable end, wherein the plurality of fixed ends are connected to portions of the plurality of fixed frame elements, and wherein the plurality of extendable ends are connected to the two side buoyancy sections so that the two side hulls are extendable relative to the center hull by shifting the two side hulls between a contracted position to an expanded position.

These and other features, aspects and advantages of the present invention will become better understood with reference to the following drawings, description and claims.

DETAILED DESCRIPTION OF THE INVENTION

Figure 1:
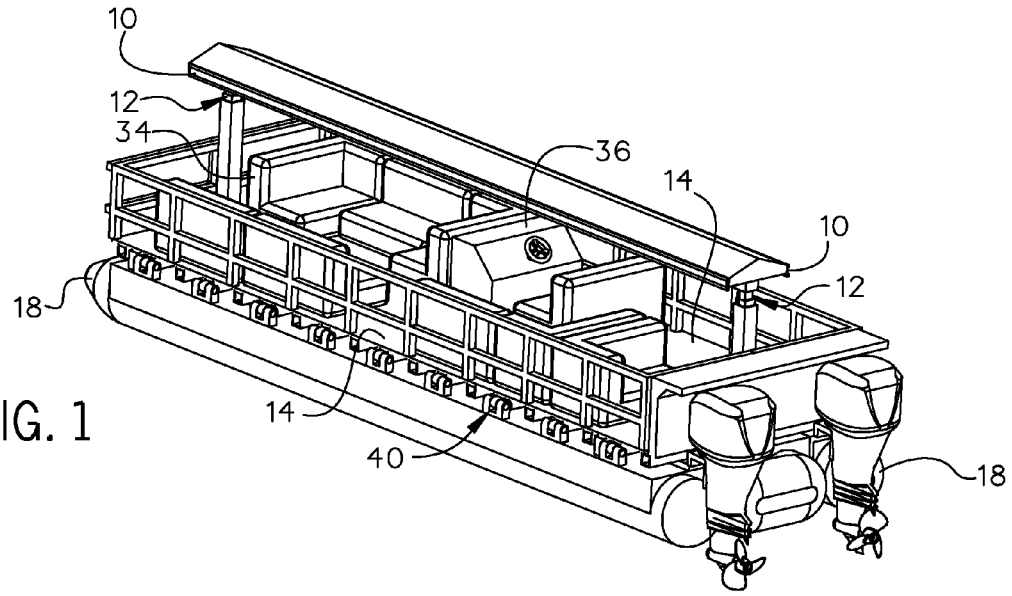
FIG. 1 is a perspective view of an exemplary embodiment of the present invention in a contracted configuration.
Figure 2:
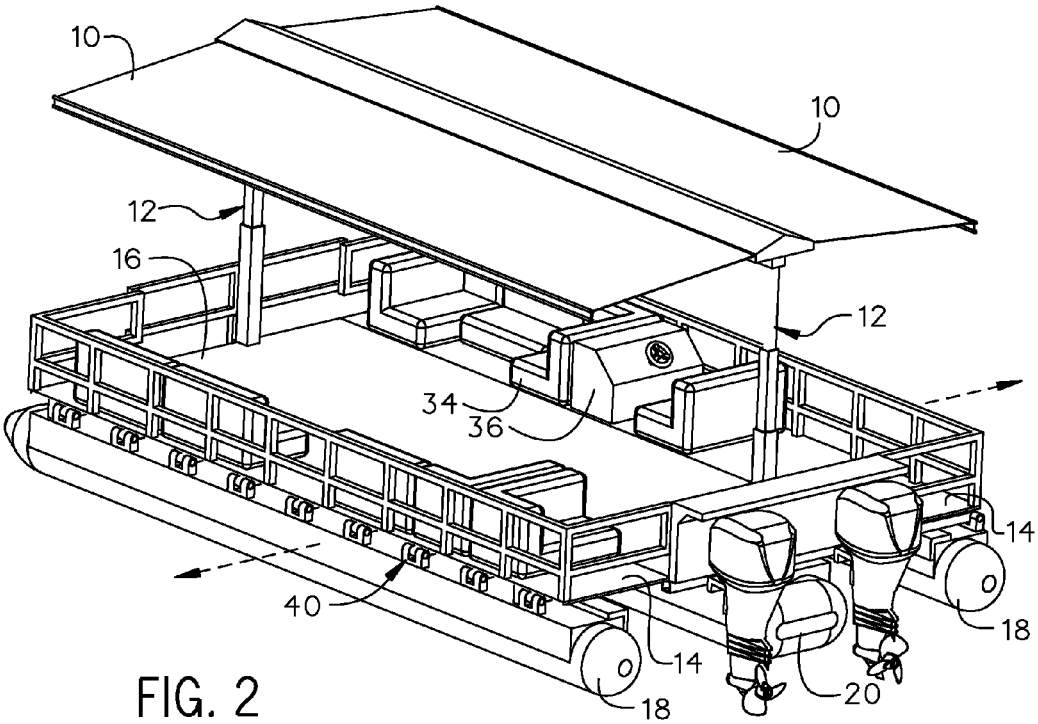
FIG. 2 is a perspective view of an exemplary embodiment of the present invention in an expanded configuration.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an extendable pontoon system. The extendable pontoon system may include a center pontoon, two side pontoons, an adjustable frame and a plurality of actuator arms. The adjustable frame may include a plurality of fixed frame elements and a plurality of slidable elements. The plurality of fixed frame elements may be supported in a traverse relationship to and along the length of the center pontoon. Each elongated slidable element may have a received end and a hinged end. Each fixed frame element may be tubular having two opposing ends, wherein each opposing end may be adapted to slidably receive one received end. The plurality of hinged ends may be pivotably connected to either one of the two side pontoons. Each actuator arm has a fixed end and an extendable end, wherein the plurality of fixed ends are connected to one fixed frame element, and wherein the plurality of extendable ends are connected to the two side pontoons so that the two side pontoons are extendable relative to the center pontoon by shifting the two side pontoons between a contracted position to an expanded position.

Referring to FIGS. 1 through 8, the present invention may include an extendable pontoon system 100. The extendable pontoon system 100 may include a fixed deck 16, two mobile decks 14, a center pontoon 20, two side pontoons 18, an adjustable frame 44 and a bracing system 46.

The pontoons 18, 20 may be buoyancy sections. The two side pontoons 18 may have an above-water surface including a padded edge 66 and a hinge edge 68. The padded edge 66 may have a plurality of pads 42 attached along at least a portion of the length of each side pontoon 18.

The adjustable frame 44 may include a plurality of elongated fixed elements 22, a plurality of elongated slidable elements 24 and a plurality of actuator arms 26. The plurality of fixed elements 22 and the plurality of slidable elements 24 may be made of material that can be repeatedly subject to bending forces without fracturing required of a seaworthy watercraft of a predetermined size. Each fixed elements 22 may be tubular, forming an opening on each opposing end for slidably receiving one slidable element 24 through each opposing end. The plurality of fixed elements 22 may be connected, for example, by welding, along the length of the center pontoon 20 at approximately evenly spaced increments.

Figure 5:
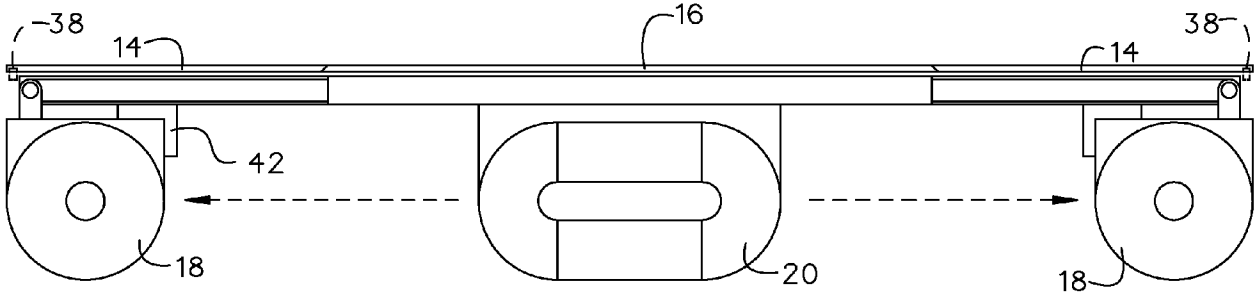
FIG. 5 is a front view of an exemplary embodiment of the present invention in the expanded configuration.
Figure 6:
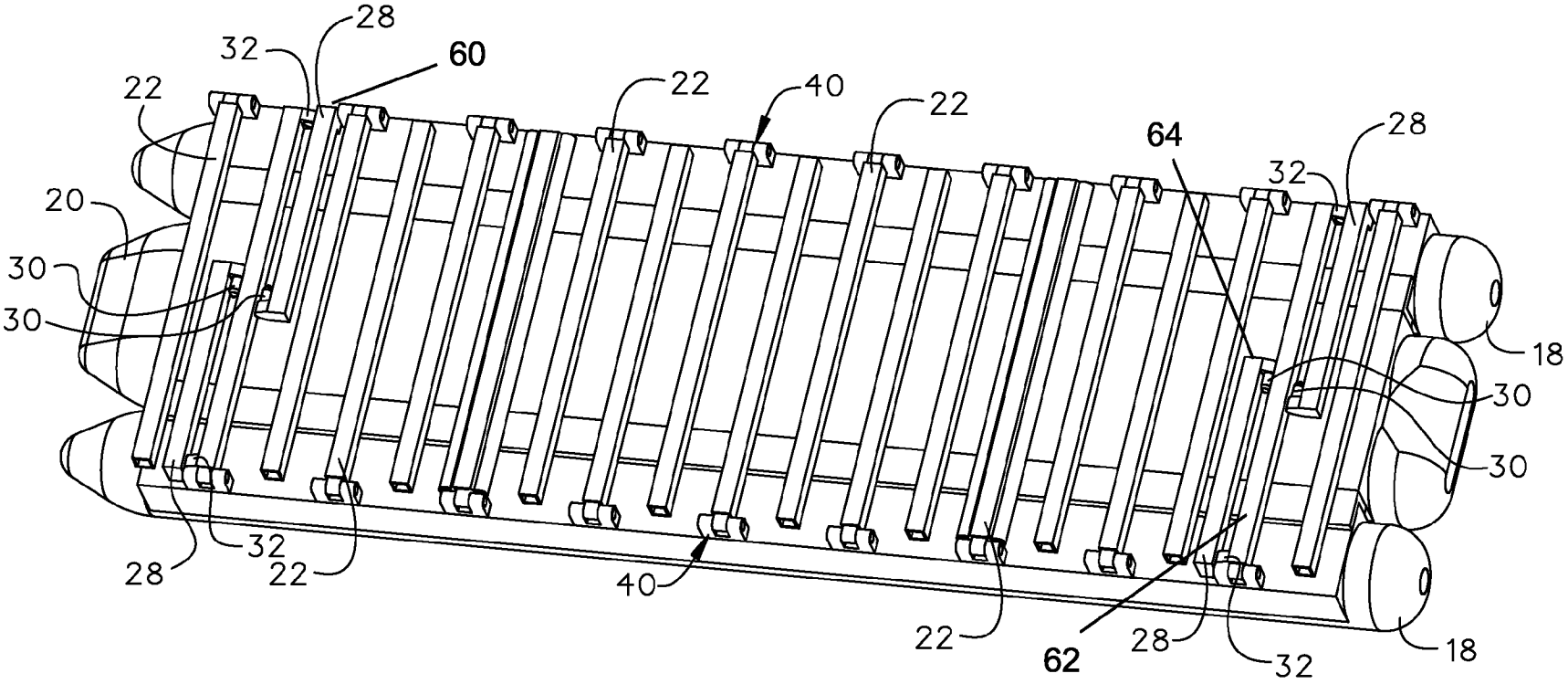
FIG. 6 is a top perspective view of an exemplary embodiment of the present invention in the contracted configuration.
Figure 7:
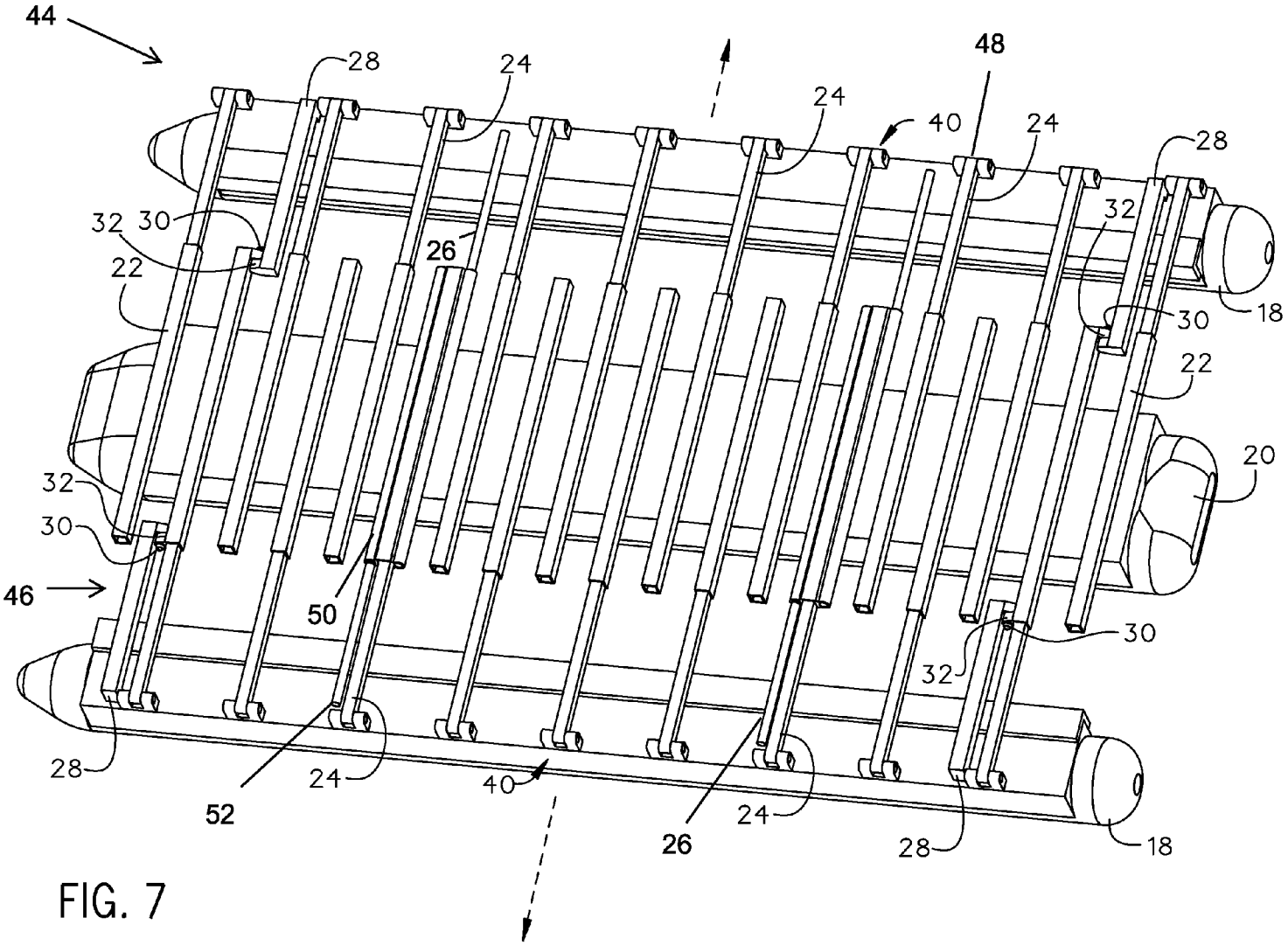
FIG. 7 is a top perspective view of an exemplary embodiment of the present invention in the expanded configuration.
Figure 8:
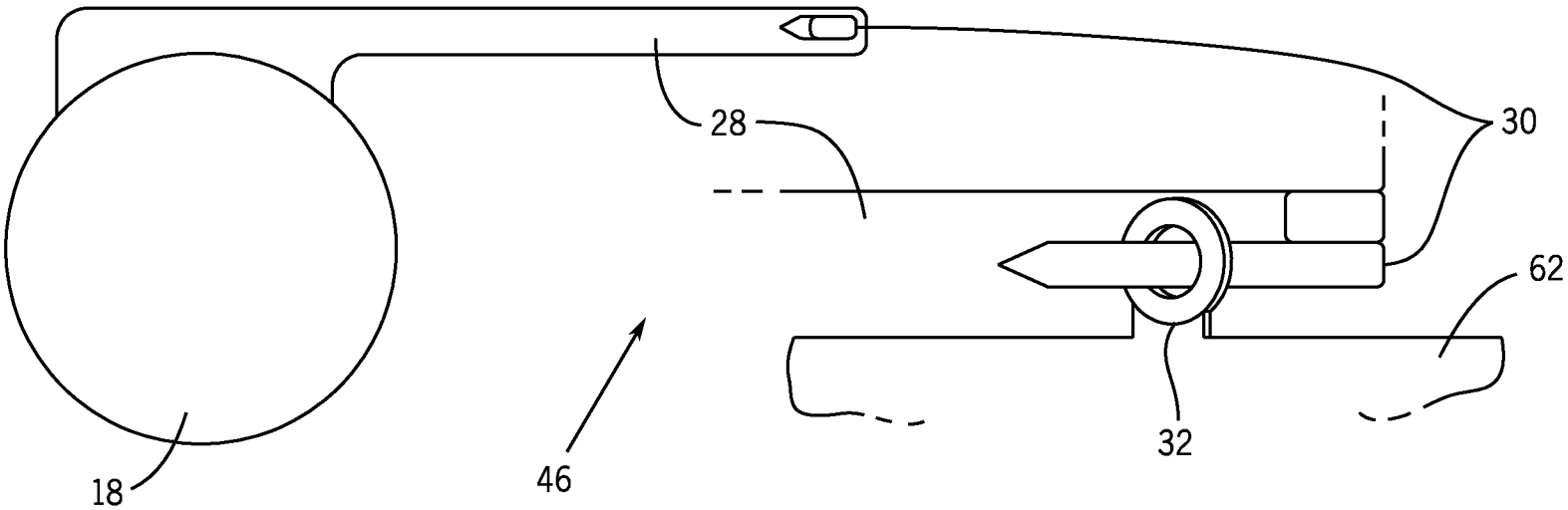
FIG. 8 is various detailed views of an exemplary embodiment of a bracing system of the present invention.

Each of the plurality of slidable elements 24 may have a received end and a hinged end 48. Each hinged end 48 may be pivotably connected to a pontoon hinge 40. The plurality of pontoon hinges 40 may be connected along the length of both side pontoons 18 padded edges 66, for example, by welding, at approximately evenly spaced increments. The plurality of pontoon hinges 40 may be adapted to restrict the extent of pivoting so as, for example, the two side pontoons 18 are not allow to pivot more than forty-five degrees about a vertical axis. The two side pontoons 18 pivoted zero degrees about the vertical axis is illustrated in FIG. 5. The plurality of pontoon hinges 40 may allow for expansion at any distance up to double the original width. For example, an eight-and-a half foot wide boat in the contracted position may extend to a seventeen foot boot, doubling the surface area, in the expanded position. It should be understood that the present invention may also enable a seven-and-a-half foot contracted position to extend to ten feet in the expanded positions.

The plurality of actuator arms 26 may be linear actuators, actuators and/or devices that creates motion in a straight line so that the adjustable frame 44 may be extended from a contracted position to an expanded position. Each actuator arm 26 may be slidably received in an actuator sleeve 50. At least one actuator sleeve 50 may be connected to at least one fixed element 22. Each actuator arm 26 may include a fixed end and an extendable end 52. Each sleeve end may be slidably received within the actuator sleeve 50. Each extendable end 52 may be fixed to one of the two side pontoons 18. The plurality of actuator arms 26 may be electric, pneumatic, hydraulic or the like. The plurality of actuator arms 26 may be independently remotely controlled from, for example, a deck control panel 36.

Figure 3:
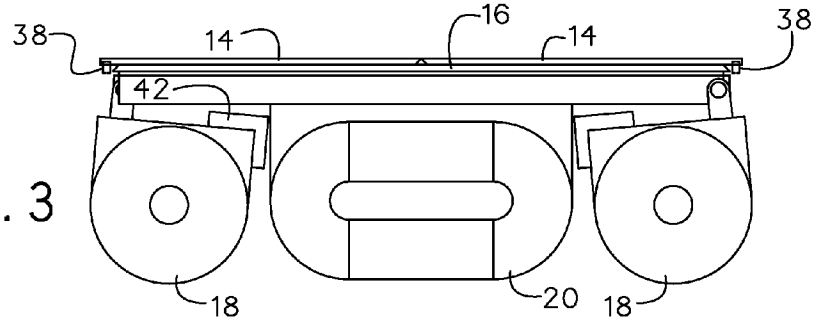
FIG. 3 is a front view of an exemplary embodiment of the present invention in the contracted configuration.
Figure 4:
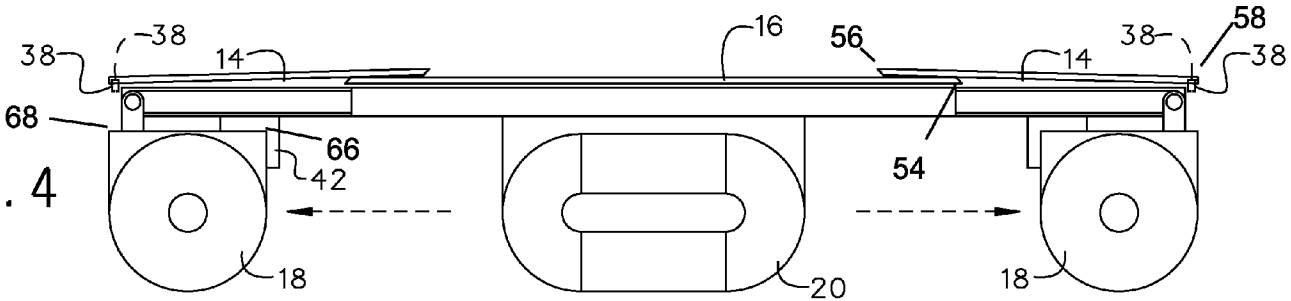
FIG. 4 is a front view of an exemplary embodiment of the present invention shown extending from the contracted configuration to the expanded configuration.

In the contracted position, the size of the two side pontoons 18 and the center pontoon 20 may urge the two side pontoons 18 to pivot about the plurality of pontoon hinges 40, as illustrated in FIG. 3, so as to accommodate wider pontoons 18, 20 for a given fixed deck 16 width than would otherwise be allowed with non-pivoting pontoon hinges 40 connections to the two side pontoons 18.

The fixed deck 16 may be connected to the plurality of fixed elements 22. The fixed deck 16 width may terminate at two longitudinal mating edges 54. Each mobile deck 14 width may terminate at a longitudinal mating edge 56 and a longitudinal roller end 58. The two mobile decks 14 may approximately abut along their respective longitudinal mating edges 56 in the contracted position, supported by the fixed deck 16 on a higher plane thereof. Each of the two roller ends 58 may be pivotably connected to a plurality of spring loaded rollers 38. The plurality of spring loaded rollers 38 may be connected to the plurality of pontoon hinges 40. The plurality of spring loaded rollers 38 may by adapted so that the two mobile decks 14 in the contracted position may share the higher plane yet share a lower plane with the fixed deck 16 in the expanded position. The two mating edges 54 and the respective mating edges 56 may abut on the lower plane in the expanded position.

In certain embodiments, the extendable pontoon system 100 may include deck furniture 34, the deck control panel 36 and at least one telescopic awning support 12 connected thereto. The at least one telescopic awning support 12 may include a retractable awning 10 adapted to provide shade to substantially all deck furniture when the extendable pontoon system 100 may be in the expanded position.

The bracing system 46 may include a plurality of anti-roll braces 28, a plurality of anti-roll male members 30 and a plurality of anti-roll female members 32. Each female member 32 may be adapted to securely receive a complimentary male member 30 in a matingly engagement. When the plurality of male members 30 are matingly engaged with the plurality of female members 32 the bracing system 46 is adapted to resist the torque imposed about each mobile deck 14 by the buoyancy forces applied through each side pontoon 18. The bracing system 46 may be adapted to minimize the size of the decking 14, 16 so as to minimize the overall weight of the extendable pontoon system 100.

A pair of female members 32 may be connected to opposing port/starboard ends of a plurality of braced fixed elements 62, with one female member 32 on a bow side and the other female member 32 on a stern side thereof.

Each anti-roll braces 28 may be made of material that can be repeatedly subject to bending forces without fracturing required of a seaworthy watercraft of a predetermined size. Each anti-roll braces 28 may include a side end 60 and a locking end 64. Each side end 60 may be connected, for example by welding, to one of the two side pontoons 18. Each locking end 64 may terminate in the male member 30.

A pair of anti-roll braces 28 may be placed so that one is disposed on the bow side and another is disposed on the stern side of the plurality of braced fixed elements 62. In the expanded position each male member 30 may be securely received by each female member 32 so as to prevent the two mobile decks 14 from extending past the expanded position.

In certain embodiments, the extendable pontoon system 100 may have only the two side pontoons 18 and no center pontoon 20. In such an embodiment, the plurality of elongated fixed elements 22 may be supported by the fixed deck 16. The fixed deck may remain in a fixed position relative to the center line of the boat and/or extendable pontoon system 100 while the two side pontoons 18 are extended and contracted.

In an alternate embodiment, the extendable pontoon system 100 may have a plurality of side pontoons 18 and at least one center pontoon 20 utilizing the plurality of actuator arms 60, the plurality of pontoon hinges 40 and the like, to move the plurality of side pontoons 18 from the expanded position to the contracted position and back, while at least one fixed deck 16 remains fixed relative to the center line of the boat and/or extendable pontoon system 100.

A method of using the present invention may include the following. The extendable pontoon system 100 disclosed above may be provided. When being transported, the extendable pontoon system 100 may be in the contracted position to abide by state law and or for traffic safety considerations. When deployed as a watercraft, the extendable pontoon system 100 may be remotely extended from the contracted position to the expanded position when afloat so as to accommodate additional cargo and/or passengers.

In certain embodiments, the extendable pontoon system 100 may be adaptable for industrial/barge applications.

It should be understood, of course, that the foregoing relates to exemplary embodiments of the invention and that modifications may be made without departing from the spirit and scope of the invention as set forth in the following claims.

What is claimed is:

1. A plurality-hull boat comprising:

a center hull comprising:

a center buoyancy section; and a plurality of fixed frame elements, wherein each fixed frame element is an elongated tube connected in a transverse relationship to and along the length of the center buoyancy section; and two side hulls, wherein one side hull is disposed on the port side of the center hull and the other side hull is disposed on the starboard side of the center hull, with each side hull comprising:

a side buoyancy section; and a plurality of slidable elements, wherein each slidable element has a received end and a hinged end, wherein each received end is slidably received by a complementary fixed frame element, wherein each hinged end is pivotably connected along the length of the side buoyancy section; and a plurality of actuator arms, wherein each actuator arm has a fixed end and an extendable end, wherein the plurality of fixed ends are connected to portions of the plurality of fixed frame elements, and wherein the plurality of extendable ends are connected to the two side buoyancy sections so that the two side hulls are extendable relative to the center hull by extending the two side hulls between a laterally contracted position to a laterally expanded position.

2. The plurality-hull boat of claim 1, further including a bracing system comprising:

a plurality of female members connected to both opposing ends of at least one fixed frame element;

a plurality of anti-roll braces aligned on opposing sides of the at least one fixed frame element, wherein the plurality of anti-roll braces are connected along the two side buoyancy sections;

a plurality of male members connected to the ends of the plurality of anti-roll braces so that in the expanded position each of the female members is matingly engaged with their complementary male member.

3. The plurality-hull boat of claim 1, further including a fixed deck supported by the plurality of fixed frame elements, and further including two mobile decks, wherein each mobile deck is supported by the respective plurality of hinged ends along each of the two side buoyancy sections.

4. The plurality-hull boat of claim 3, furthering including a plurality of spring loaded rollers, wherein the plurality of spring loaded rollers connect the two mobile decks to the plurality of hinged ends.

5. A plurality-hull boat comprising:

a port side hull and a starboard side hull, with each hull comprising:

a side buoyancy section;

a plurality of slidable elements, wherein each slidable element has a received end and a hinged end, wherein each hinged end is pivotably connected along the length of the side buoyancy section; and a mobile deck supported by the plurality of hinged ends; and a center hull comprising;

a plurality of fixed frame elements, wherein each fixed frame element is an elongated tube extending from the port side hull to the starboard side hull, wherein each fixed frame element forms one opening on each opposing end for slidably receiving a complementary slidable element; and a fixed deck supported by and reinforcing the plurality of fixed frame elements; and a plurality of actuator arms, wherein each actuator arm has a fixed end and an extendable end, wherein the plurality of fixed ends are connected to portions of the plurality of fixed frame elements, and wherein the plurality of extendable ends are connected to the both side buoyancy sections so that both side hulls are extendable relative to the center hull by extending both side hulls between a laterally contracted position to a laterally expanded position.

6. The plurality-hull boat of claim 5, further including a bracing system comprising:

a plurality of female members connected to both opposing ends of at least one fixed frame element;

a plurality of anti-roll braces aligned on opposing sides of the at least one fixed frame element, wherein the plurality of anti-roll braces are connected along the two side buoyancy sections;

a plurality of male members connected to the ends of the plurality of anti-roll braces so that in the expanded position each of the female members is matingly engaged with their complementary male member.

7. The plurality-hull boat of claim 5, furthering including a plurality of spring loaded rollers, wherein the plurality of spring loaded rollers connect the two mobile decks to the plurality of hinged ends.

* * * * *